US007900283B1

(12) United States Patent
Chen

(10) Patent No.: US 7,900,283 B1
(45) Date of Patent: Mar. 8, 2011

(54) CHEST PROTECTOR FOR BASEBALL GAME

(75) Inventor: Shyan-Wei Chen, Taipei Hsien (TW)

(73) Assignee: Racer Sporting Goods Co. Ltd., Taipei Hsien (TW)

( * ) Notice: Subject to any disclaimer, the term of this patent is extended or adjusted under 35 U.S.C. 154(b) by 158 days.

(21) Appl. No.: 12/487,807

(22) Filed: Jun. 19, 2009

(51) Int. Cl.
*A41D 27/12* (2006.01)
*F41H 1/00* (2006.01)
*A41D 1/04* (2006.01)

(52) U.S. Cl. ..... 2/455; 2/459; 2/463; 2/464; 2/92; 2/267

(58) Field of Classification Search ..... 2/455, 459, 2/463, 464, 466, 2.5, 92, 267, 913
See application file for complete search history.

(56) References Cited

U.S. PATENT DOCUMENTS 3,125,762 A * 3/1964 Glahe ..... 2/463
4,525,875 A * 7/1985 Tomczak ..... 2/463
5,020,156 A * 6/1991 Neuhalfen ..... 2/462
5,093,931 A * 3/1992 LaBerge et al. ..... 2/22
6,156,000 A * 12/2000 Chen et al. ..... 602/62
6,182,299 B1 * 2/2001 Chen ..... 2/463
6,421,840 B1 * 7/2002 Chen et al. ..... 2/410
6,678,899 B2 * 1/2004 Fiorini et al. ..... 2/463
6,775,851 B1 * 8/2004 Chen et al. ..... 2/463
D501,690 S * 2/2005 Chen ..... D29/120.1
6,964,062 B1 * 11/2005 Chen ..... 2/22
D628,347 S * 11/2010 Chen ..... D29/106
2002/0056521 A1 * 5/2002 Chen et al. ..... 156/410
2003/0024035 A1 * 2/2003 Fiorini et al. ..... 2/463
2004/0003456 A1 * 1/2004 Nishimoto ..... 2/463
2008/0295231 A1 * 12/2008 Wright ..... 2/455

* cited by examiner

*Primary Examiner* — Bobby H Muromoto, Jr.
(74) *Attorney, Agent, or Firm* — Jackson IPG PLLC; Demian K. Jackson

(57) ABSTRACT

A chest protector formed of a base, upper and lower shoulder straps, a neck pad, neck cushions, shoulder cushions, chest cushions, upper and lower abdomen cushions, lateral cushions, bottom cushions and breathing cloths. Each upper abdomen cushion is formed of an inner low bounce foam, an outer low bounce foam and an intermediate hard plastic board sandwiched in between the inner low bounce foam and outer low bounce foam. Each lower abdomen cushion is formed of an inner low bounce foam and an outer low bounce foam. The inner low bounce foam of each abdomen cushion is shorter and relatively softer than the associating outer low bounce form so that a buffer space is defined between the outer low bounce foam of each abdomen cushion and the base below the associating inner low bounce foam and the outer low bounce foams of the abdomen cushions are respectively held in a sloping status after stitching of the breathing cloths to the base.

1 Claim, 6 Drawing Sheets

CHEST PROTECTOR FOR BASEBALL GAME

BACKGROUND OF THE INVENTION

1. Field of the Invention

The present invention relates to a chest protector for baseball game and more particularly, to such a chest protector that effectively absorbs shocks when hit by a ball and enables the user (catcher) to catch the ball on the first bound.

2. Description of the Related Art

A conventional chest protector for baseball game generally has a plurality of cushions 91, 92, 93, 94, 95, 96, 97, 98 mounted on a base 9 to absorb shocks when hit by the ball. However, when the ball hit the abdomen cushions of the chest protector, the ball may bounce from the check protector to an unexpected place. The user (catcher) may waste a lot of time to catch the ball. Further, when the ball bounces from the chest protector, it may hit the user (catcher), the hitter or the umpire accidentally.

U.S. Pat. No. 6,775,851 discloses an improved design of chest protector entitled "Structure of chest protector" and issued to the present inventor. This design of chest protector gives a comfortable wearing. However, when the ball hit the abdomen cushions of the chest protector, the ball may bounce in any unexpected direction, causing the user (catcher) unable to catch the ball on the first bounce. Further, when the ball bounces from the chest protector, it may hit the user (catcher), the hitter or the umpire accidentally.

Accordingly, there is a need for a chest protector that eliminates the aforesaid problems.

SUMMARY OF THE INVENTION

The present invention has been accomplished to provide a chest protector, which effectively absorb shocks when hit by the ball and, which guides the ball to bound from the chest protector to the ground in front of the user (catcher) so that the user (catcher) can catch the ball quickly and the bounce of the ball will not hit the user, the hitter or the umpire accidentally, assuring a high level of safety.

To achieve this and other objects of the preset invention, the chest protector is formed of a base, upper and lower shoulder straps, a neck pad, neck cushions, shoulder cushions, chest cushions, upper and lower abdomen cushions, lateral cushions, bottom cushions and breathing cloths. Each upper abdomen cushion is formed of an inner low bounce foam, an outer low bounce foam and an intermediate hard plastic board sandwiched in between the inner low bounce foam and outer low bounce foam. Each lower abdomen cushion is formed of an inner low bounce foam and an outer low bounce foam. The inner low bounce foam of each abdomen cushion is shorter and relatively softer than the associating outer low bounce form. When the breathing cloths are stitched to the base, the outer low bounce foams of the abdomen cushions are respectively held in a sloping status with a respective buffer space defined therein below the respective inner low bounce foams. Therefore, when the ball hit the abdomen cushions, the buffer spaces enhance the shock-absorbing and buffering effects of the chest protector, and the sloping angle of the outer low bounce foams of the abdomen cushions guides the ball to bound from the chest protector to the ground in front of the user (catcher) so that the user (catcher) can catch the ball quickly and the bounce of the ball will not hit the user (catcher), the hitter or the umpire accidentally, assuring a high level of safety.

DETAILED DESCRIPTION OF THE INVENTION

Figure 1:
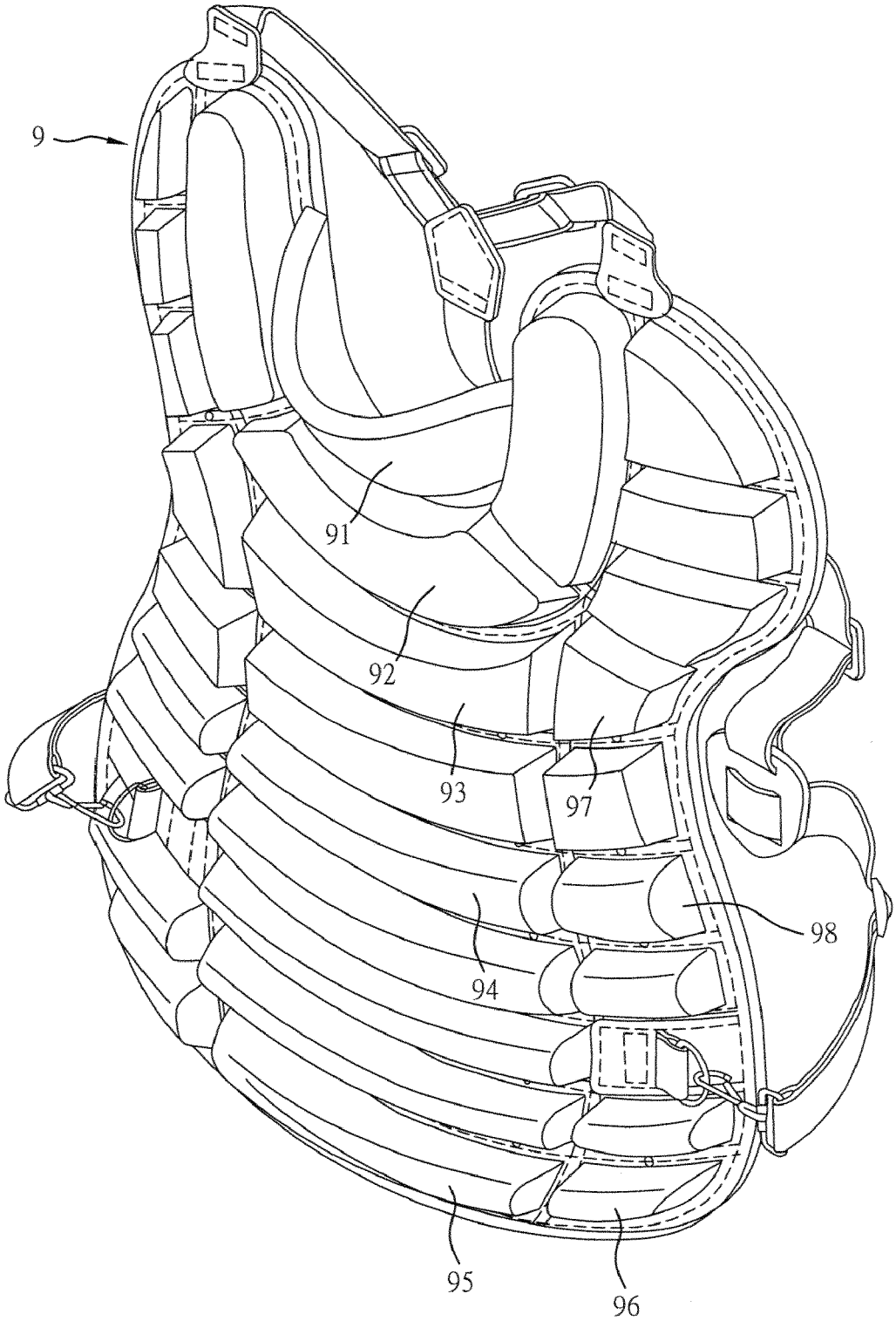
Fig. 1 PRIOR ART
FIG. 1 is an elevational view of a chest protector according to the prior art.
Figure 2:
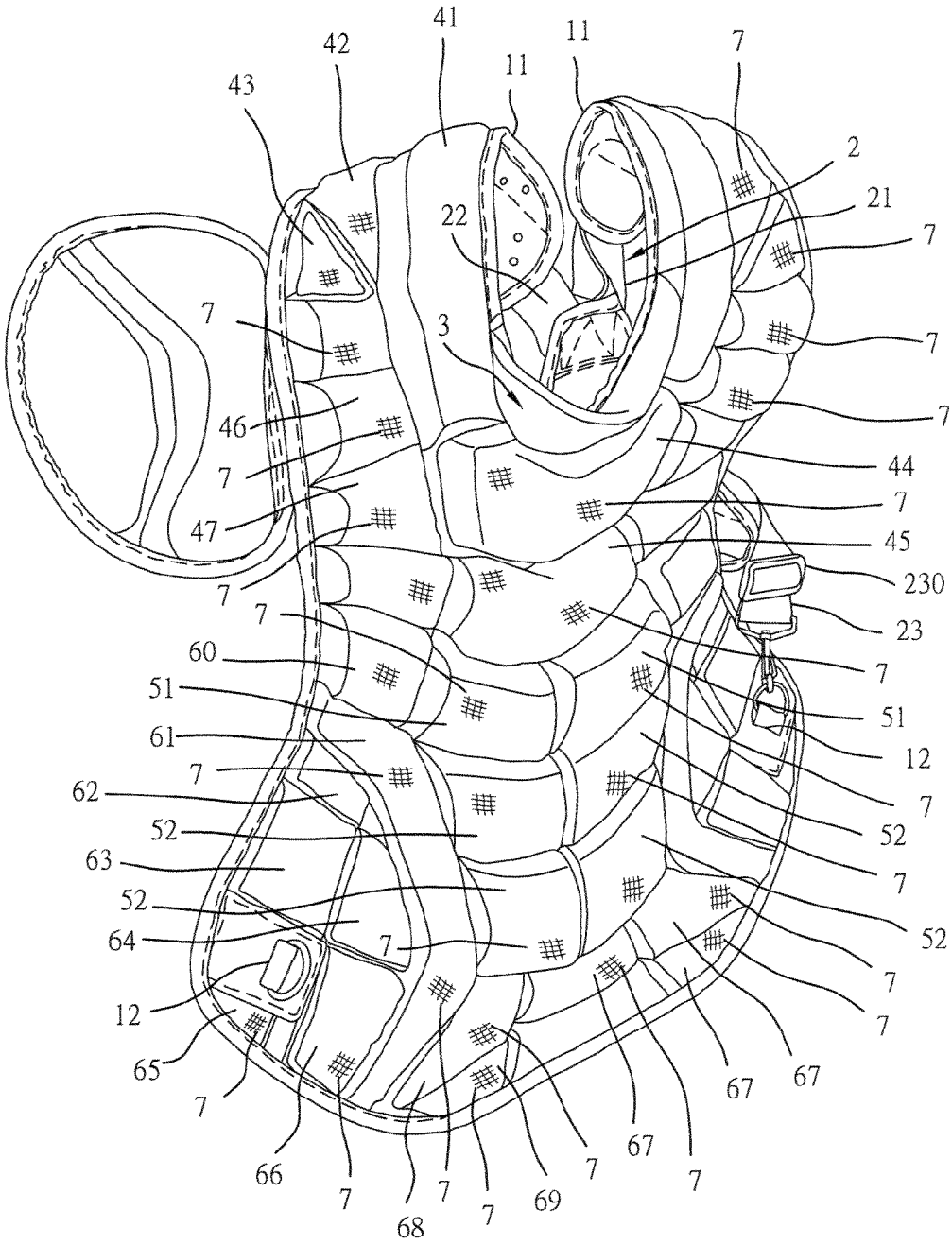
FIG. 2 is a perspective view of a chest protector according to the present invention.
Figure 3:
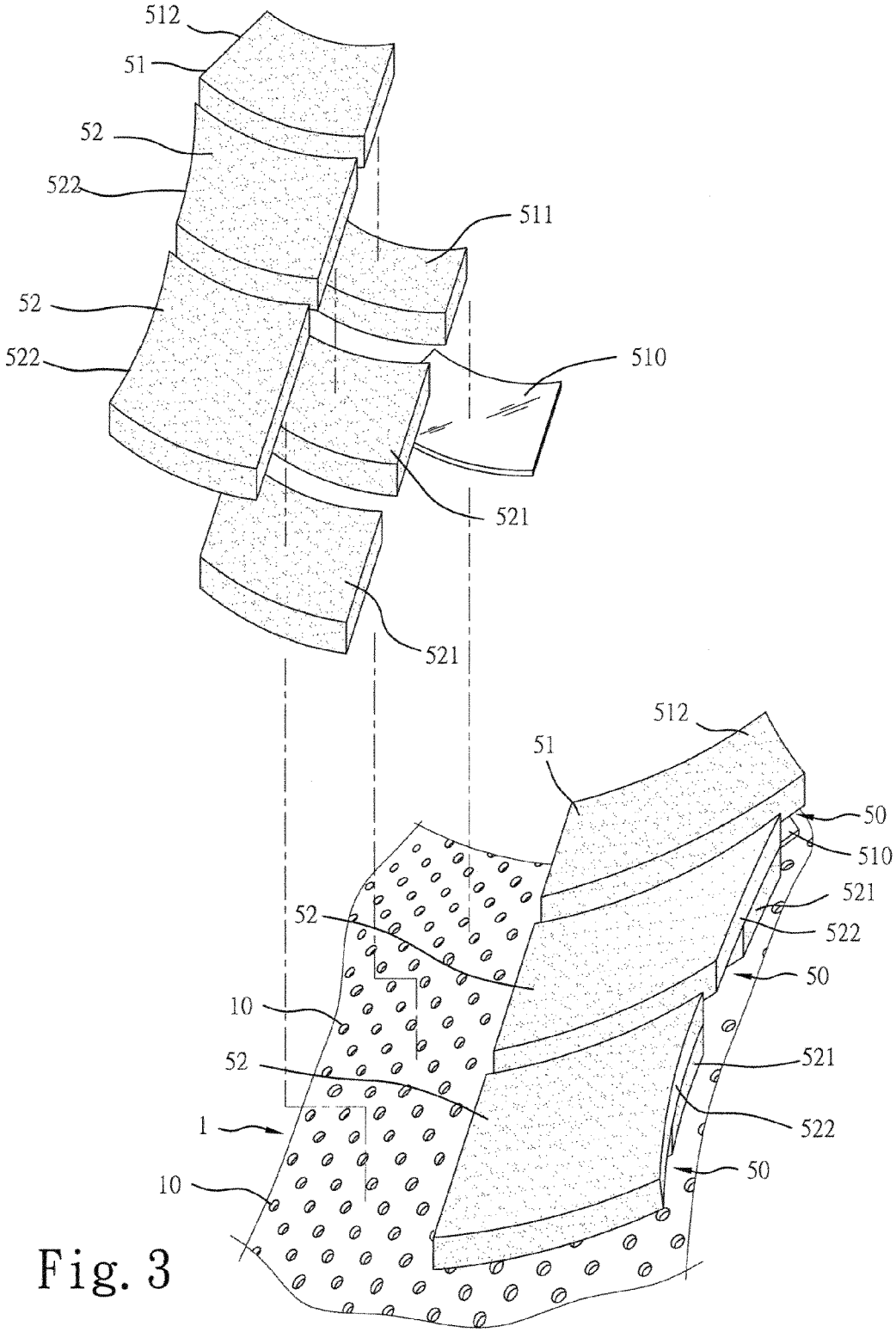
FIG. 3 is an exploded view of a part of the present invention, showing the structure of the abdomen cushions of the chest protector.
Figure 5:
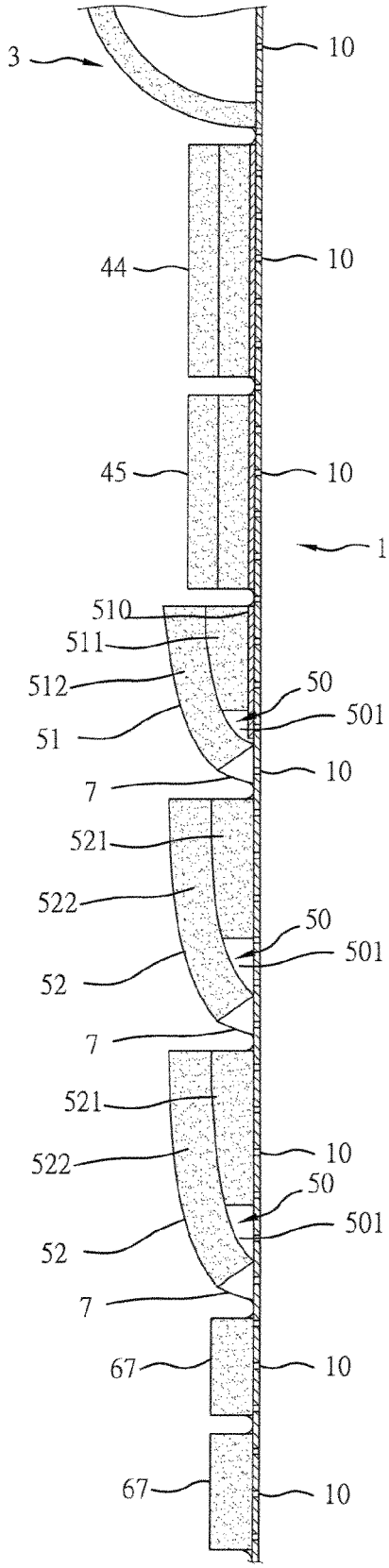
FIG. 5 is a sectional view in an enlarged scale of the chest protector according to the present invention.
Figure 6:
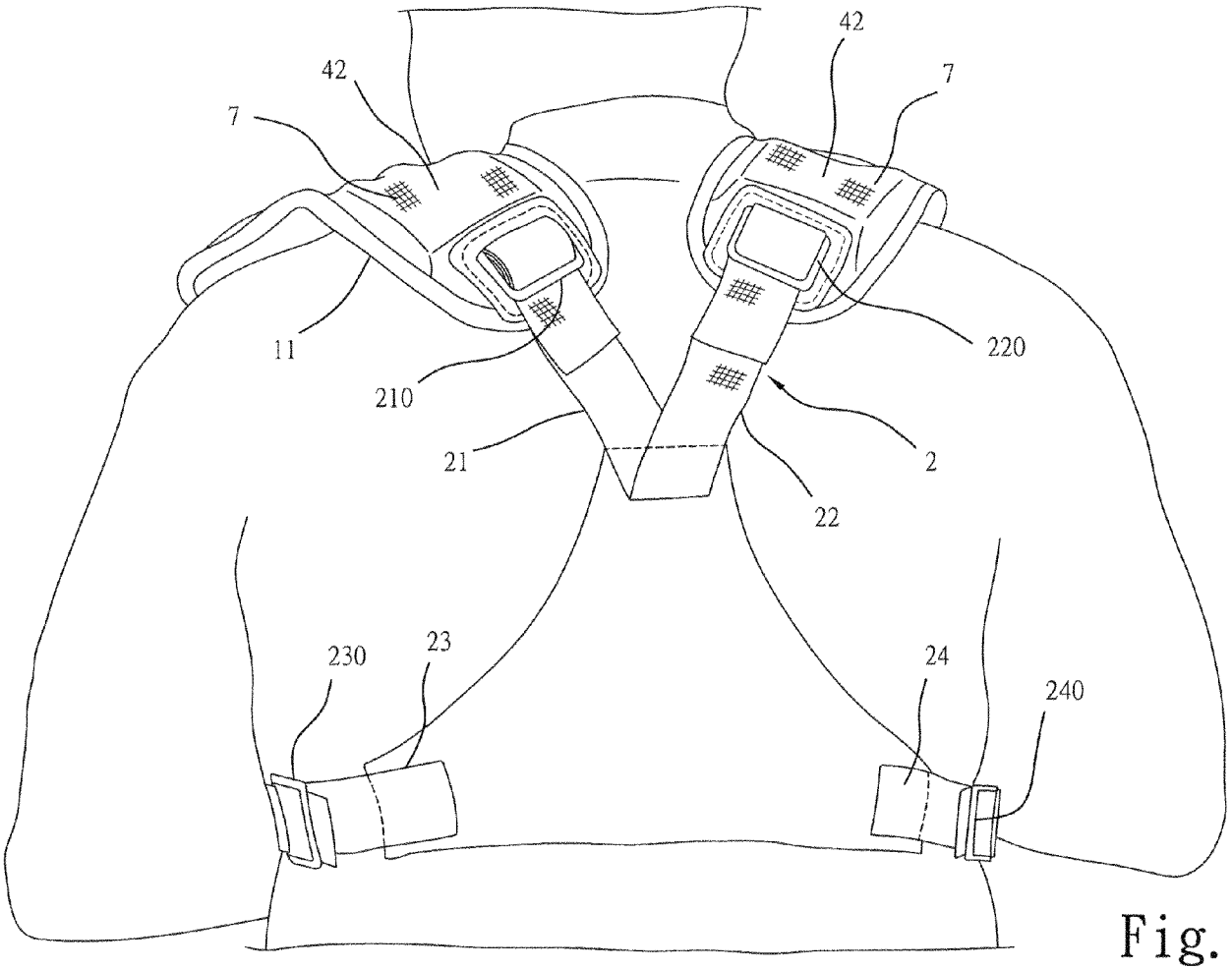
FIG. 6 is a schematic drawing of the present invention, showing the chest protector fastened to the user's back.

Referring to FIGS. 2-6, a chest protector is shown comprising:

a base 1 made of ethylene vinyl acetate foam material not heat pressed, having a suitable thickness and a plurality of air vents 10 (see FIGS. 3 and 5);

a set of shoulder straps 2 (see FIG. 6), which includes two upper shoulder straps 21;22 and two lower shoulder straps 23;24 wherein the upper shoulder straps 21;22 each are provided with a strap frame 210;220, having a top end respectively connected to the shoulder portions 11 of the base 1; the lower shoulder straps 23;24 each are provided with a strap frame 230;240, having one end respectively connected to the two opposite lateral flank portions 12 of the base 1;

a neck pad 3 fastened to the top side of the base 1 corresponding to the user's neck;

neck cushions 41 respectively fastened to the top side of the base 1 corresponding to two opposite lateral sides of the user's neck;

shoulder cushions 42 and 43 respectively fastened to the front side of the base 1 corresponding to the user's shoulders;

chest cushions 44, 45, 46 and 47 respectively fastened to the front side of the base 1 corresponding to the area around the user's chest;

abdomen cushions 51 and 52 respectively fastened to the front side of the base 1 corresponding to the user's abdomen wherein the two upper abdomen cushions 51 each comprise an inner low bounce foam 511, an outer low bounce foam 512, and an intermediate hard plastic board 510, for example, hard polyethylene board 510 sandwiched in between the inner low bounce foam 511 and the outer low bounce foam 512; the four lower abdomen cushions 52 each comprise an inner low bounce foam 521 and an outer low bounce foam 522;

lateral cushions 60, 61, 62, 63, 64, 65 and 66 respectively fastened to the front side of the base 1 corresponding to the two opposite lateral sides of the user's abdomen;

bottom cushions 67, 68 and 69 respectively fastened to the front side of the base 1 corresponding to the lower part of the user's abdomen; and breathing cloths 7 stitched to the base 1 and covered on the neck pad 3, the neck cushions 41, the shoulder cushions 42 and 43, the chest cushions 44, 45, 46, the abdomen cushions 51 and 52, the lateral cushions 60, 61, 62, 63, 64, 65 and 66 and the bottom cushions 67, 68 and 69.

Figure 4:
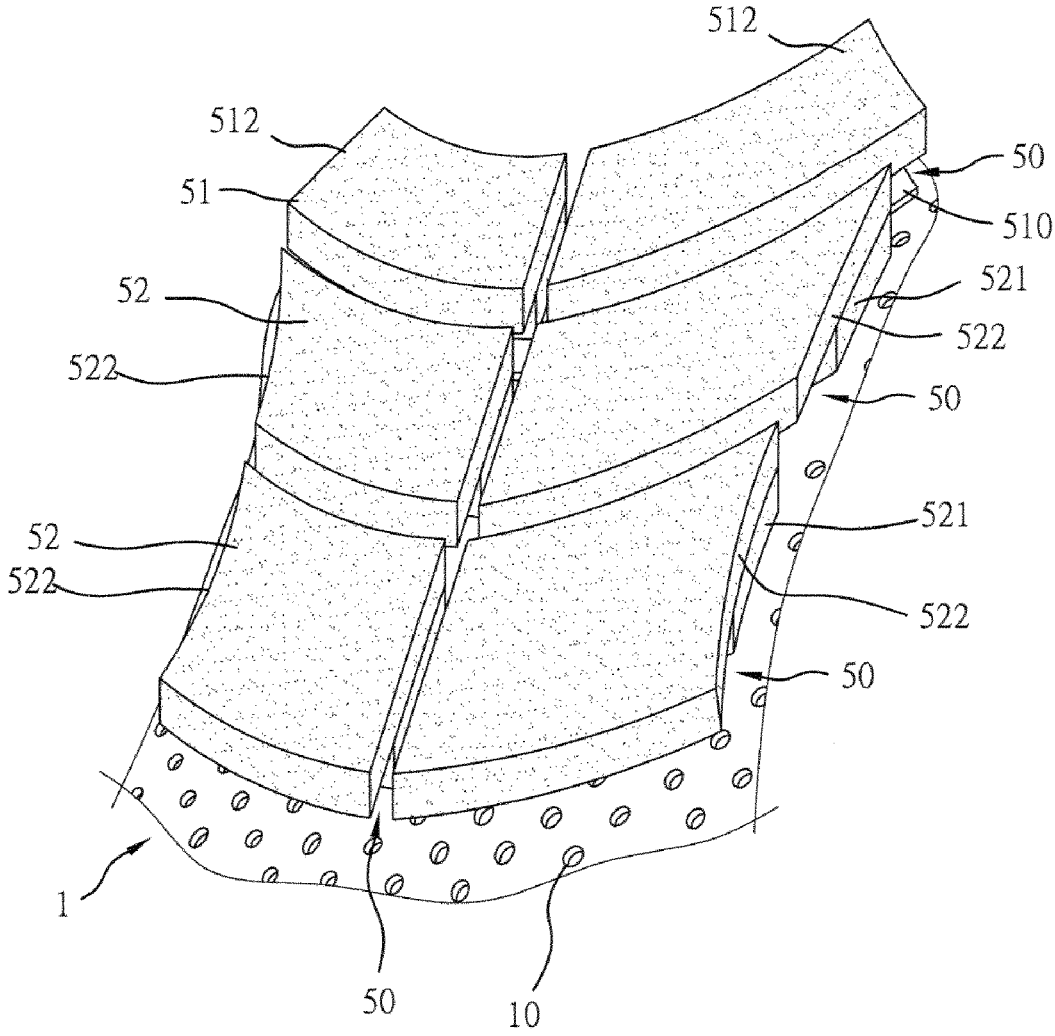
FIG. 4 is an assembly view of FIG. 3.

The main features of the present invention are outlined hereinafter with reference to FIGS. 3-5. The inner low bounce foams 511 and 521 of the abdomen cushions 51 and 52 are relatively shorter than the outer low bounce foams 512 and 522 of the respective abdomen cushions 51 and 52 so that buffer spaces 50 are provided between the respective outer low bounce foams 512 and 522 and the base 1 below the respective inner low bounce foams 511 and 521 (see FIG. 3). Further, the inner low bounce foams 511 and 521 are relatively softer than the respective outer low bounce foams 512 and 522 so that when the breathing cloths 7 are stitched to the base 1, the outer low bounce foams 512 and 522 of the abdomen cushions 51 and 52 are respectively held in a sloping status with a respective buffer space 501 defined therein below the respective inner low bounce foams 511 and 521 (see FIG. 5). When the ball hit the abdomen cushions 51 and 52, the buffer spaces 50 enhance the shock-absorbing and buffering effects of the chest protector, and the sloping angle of the outer low bounce foams 512 and 522 of the abdomen cushions 51 and 52 guides the ball to bound from the chest protector to the ground in front of the user (catcher) so that the user (catcher) can catch the ball on the first bound and the bounce of the ball will not hit the hitter or the umpire accidentally, assuring a high level of safety.

As indicated, the chest protector of the present invention provides the following advantages.

1. When the ball hit the abdomen cushions 51 and 52, the abdomen cushions 51 and 52 absorb shocks and guide the ball to bound from the chest protector to the ground in front of the user (catcher) so that the user (catcher) can catch the ball on the first bound and the bounce of the ball will not hit the hitter or the umpire accidentally, assuring a high level of safety.

2. The base made of ethylene vinyl acetate has lightweight and thin thickness (about 3 mm) characteristics for a comfortable wearing. When the ball hit the chest protector, the distance of bounce of the ball is minimized.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A chest protector comprising:

a base made of ethylene vinyl acetate foam material not heat pressed, said base having a plurality of air vents;

a set of shoulder straps, said set of shoulder straps comprising two upper shoulder straps and two lower shoulder straps, said upper shoulder straps each being provided with a strap frame, having a top end respectively connected to shoulder portions of said base, said lower shoulder straps each being provided with a strap frame, having one end respectively connected to two opposite lateral flank portions of said base;

a neck pad fastened to said base corresponding to the user's neck;

a plurality of neck cushions respectively fastened said base corresponding to two opposite lateral sides of the user's neck;

a plurality of shoulder cushions respectively fastened to said base corresponding to the user's shoulders;

a plurality of chest cushions respectively fastened to said base corresponding to the area around the user's chest;

a set of abdomen cushions, said set of abdomen cushions comprising two upper abdomen cushions and four lower abdomen cushions respectively fastened to said base corresponding to the user's abdomen, said two upper abdomen cushions each comprising an inner low bounce foam, an outer low bounce foam, and an intermediate hard plastic board sandwiched in between the inner low bounce foam and outer low bounce foam of the respective upper abdomen cushion; said four lower abdomen cushions each comprising an inner low bounce foam and an outer low bounce foam;

a plurality of lateral cushions respectively fastened to said base corresponding to the two opposite lateral sides of the user's abdomen;

a plurality of bottom cushions respectively fastened to said base corresponding to the lower part of the user's abdomen; and a plurality of breathing cloths stitched to said base and covered on said neck pad, said neck cushions, said shoulder cushions, said chest cushions, said abdomen cushions, said lateral cushions and said bottom cushions;

wherein the inner low bounce foams of said abdomen cushions are relatively shorter than the outer low bounce foams of the respective abdomen cushions and a buffer space is defined between the outer low bounce foam of each said abdomen cushion and said base below the inner low bounce foam of the respective abdomen cushion; the inner low bounce foams of said abdomen cushions are relatively softer than the outer low bounce foams of the respective abdomen cushions so that when said breathing cloths are stitched to said base, the outer low bounce foams of said abdomen cushions are respectively held in a downwardly sloping status and a respective buffer space is defined therein below the associating inner low bounce foam.

* * * * *